United States Patent [19]

Huydts

[11] 4,179,915

[45] Dec. 25, 1979

[54] APPARATUS FOR THE EXTERNAL CALIBRATION (SIZING) OF TUBULAR ELEMENTS

[75] Inventor: Eduard J. C. Huydts, Düsseldorf-Gerresheim, Fed. Rep. of Germany

[73] Assignee: G. Siempelkamp GmbH & Co., Krefeld, Fed. Rep. of Germany

[21] Appl. No.: 848,323

[22] Filed: Nov. 3, 1977

[30] Foreign Application Priority Data

Nov. 5, 1976 [DE] Fed. Rep. of Germany ..... 2650691

[51] Int. Cl.[2] ..... B21D 41/00

[52] U.S. Cl. ..... 72/402; 72/367; 72/452

[58] Field of Search ..... 72/402, 452, 367

[56] References Cited

U.S. PATENT DOCUMENTS

| | | | |
|---|---|---|---|
| 3,303,681 | 2/1967 | Le Fieli | 72/402 X |
| 3,362,212 | 1/1968 | Steele et al. | 72/402 |
| 3,370,451 | 2/1968 | Scheutz | 72/402 |
| 3,417,598 | 12/1968 | Valente | 72/402 X |
| 3,461,710 | 8/1969 | Luedi et al. | 72/402 X |

*Primary Examiner*—Leon Gilden

*Attorney, Agent, or Firm*—Karl F. Ross

[57] ABSTRACT

An apparatus for the external calibration (sizing) of tubular elements such as longitudinally welded large-diameter pipes, comprises an outer support ring, a wedging mechanism connected to this ring, and a plurality of pipe-engaging calibrating elements which are closed against the external surface of the pipe as the latter is drawn through the apparatus to impart the desired external diameter thereto. According to the invention, the outer support ring forms a cylinder within which an annular piston is displaceable, the piston being formed with surfaces inclined to the axis of the pipe and acting directly or indirectly upon the pipe-engaging elements.

7 Claims, 4 Drawing Figures

APPARATUS FOR THE EXTERNAL CALIBRATION (SIZING) OF TUBULAR ELEMENTS

FIELD OF THE INVENTION

The present invention relates to an apparatus for the external calibration (sizing) of tubular elements and, more particularly, to an apparatus for imparting the desired external diameter to longitudinally welded large-diameter pipes or other tubular structures.

BACKGROUND OF THE INVENTION

The external calibration or sizing of large-diameter tubular elements, such as longitudinally welded or so-called longitudinal-seam pipes and like large-diameter structures such as drums, tanks and the like, generally comprises a die or other structure through which the tubular element is drawn for imparting the desired external diameter thereto.

In U.S. Pat. No. 3,461,710, for example, a supporting outer ring is mounted upon a machine frame and is provided with a plurality of wedges which are fixed to the outer ring. These wedges are individually displaced by an array of cylinder arrangements (fluid-operated piston-and-cylinder assemblies) which are distributed around the periphery of the ring and are supported by the machine frame.

By actuating these cylinder arrangements, the support ring and the wedge mechanisms are displaced to adjust the tool segments which engage the tubular element and impart the desired diameter to the tube.

The support ring can be mounted in or guided in the machine frame as well. This system has been found to be expensive, difficult to manipulate and incapable of adjustment in all cases for the sizing or calibration of large-diameter tubular bodies.

OBJECT OF THE INVENTION

It is the principal object of the present invention to provide an apparatus for the calibration (sizing) of tubular elements, especially longitudinal-seam welded pipes of large diameter, whereby the multiplicity of cylinder arrangements is eliminated and simpler but more reliable means is provided for adjusting the tool elements along the inner periphery of the apparatus.

SUMMARY OF THE INVENTION

This object and others which will become apparent hereinafter are attained, in accordance with the present invention, by providing an apparatus for the purposes described in which the outer support ring is constituted as a cylinder of an axially effective piston-cylinder arrangement cooperating with an annular piston which in turn is axially displaceable by pressurizing a compartment formed between this cylinder and the piston. Along the internal surfaces of the annular piston, there are provided wedging faces which act upon the tool elements directly or indirectly, these tool elements being thus directly provided with complementary wedge surfaces or being engaged by wedging elements which, in turn, are provided with complementary wedge surfaces and serve as intermediate elements between the wedge surfaces of the piston and the tool elements.

The apparatus of the present invention thus substitutes a single annular piston for the multiplicity of cylinder arrangements which have been provided heretofore. According to the invention, therefore, the annular piston forms part of the wedging mechanism.

The annular piston is formed directly with the adjusting wedge faces for the tool elements. This mechanism has been found to be an especially compact construction which is highly reliable and is capable of uniformly pressing the tool elements against the surface of the tubular structure to be calibrated.

The present invention is based upon the discovery that by applying the hydraulic medium pressure to the external periphery of the piston which in part is coaxial with the cylinder formed by the outer support ring and disposing the wedging faces of this piston radially inwardly of the tubular surface of the piston which is exposed to the hydraulic medium pressure, it is possible to balance the stresses upon the piston so that there is a minimal, if any, change in the diameter thereof. Naturally, an appropriate inclination of the wedging faces is required for this end to be achieved. Specifically, the angle included between the wedging faces of the piston and the axis of the apparatus should be less than 45° and is most advantageously less than 30°. Any angle in excess of, say, 1° will be effective for this purpose.

The hydraulic pressure medium distributes the inward force substantially uniformly and radially onto the annular piston and these forces are balanced by the outward forces of the wedging mechanism. As a result, when the calibrating unit thus formed effects a diameter reduction or a diameter increase of the tubular body, there is little if any change in the diameter of the piston.

A corresponding force balance is not, however, required for the outer support ring since the reaction forces, applied radially outwardly to the latter, can be taken up fully by the machine frame or by making the outer support ring of larger diameter or greater radial thickness than the piston.

In many cases, a balance between the wedge-generated radial forces upon the annular piston and the hydraulic forces applied thereto is not required and it suffices to provide sealing elements between the cylinder and the ring in such fashion that a diameter reduction or enlargement of the ring is compensated or avoided.

In either case, sealing rings are provided at opposite axial ends of the pressurizable compartment between the annular piston and the support ring or cylinder. These sealing rings can be disposed between juxtaposed cylindrical surfaces of the piston and the cylinder.

The apparatus of the present invention eliminates the numerous cylinder arrangements hitherto required about the periphery of the support ring and around the pipe to be calibrated. The apparatus has a compact and simple configuration which is highly reliable.

According to the present invention, the annular piston can be of a double-acting-type so that not only serves for the adjustment of the tool elements but for resetting of the piston. However, best results are obtained when the compartment is pressurized to position the tool elements for the calibration operation while the restoring movement of the annular piston is effected by one or more restoring-cylinder assemblies which are carried by the machine frame or support.

In addition, best results are obtained when the piston does not directly engage the tool elements but intermediate wedge members are provided between them.

In either case, the complementary wedge faces are preferably formed on dovetail structures which link the intermediate element or the tool element to the piston ring. When the intermediate elements are provided, however, they are connected to the tool elements by similar dovetail arrangements.

The annular piston can be provided with continuously adjustable mechanical abutments which limit the stroke of the annular piston.

The latter abutments can also serve as adjustments for the extreme positions of the tool elements, i.e. setting the minimum and maximum diameter of the calibrating apparatus.

BRIEF DESCRIPTION OF THE DRAWING

The above and other objects, features and advantages of the present invention will become more readily apparent from the following description, reference being made to the acccompanying drawing in which.

SPECIFIC DESCRIPTION

Figure 1:
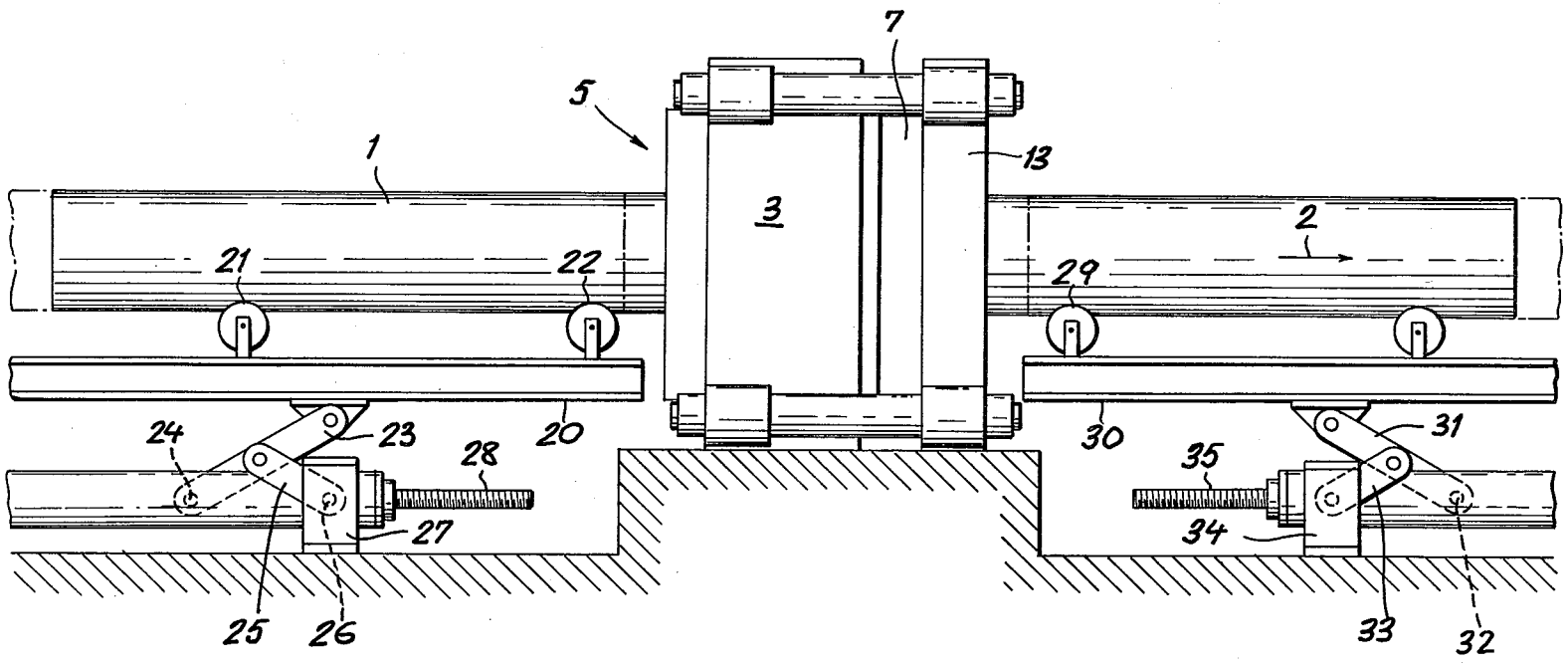
FIG. 1 is a somewhat diagrammatic vertical-elevational view of an apparatus embodying the present invention.
Figure 2:
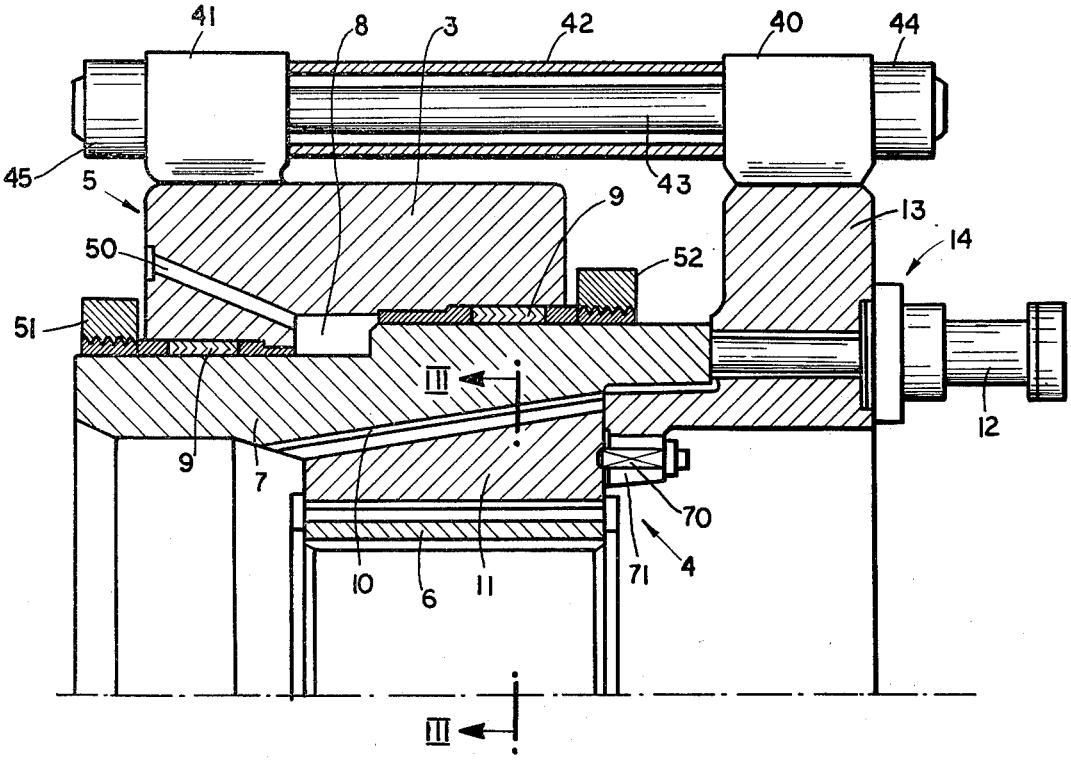
FIG. 2 is a partial axial section through a portion of the apparatus of FIG. 1, drawn to an enlarged scale and partly broken away.
Figure 3:
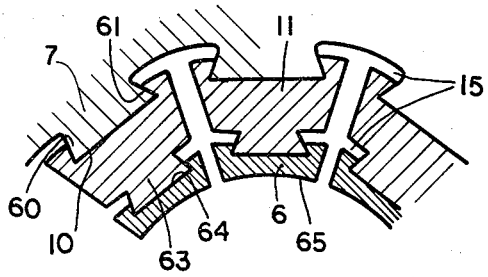
FIG. 3 is a cross-sectional view taken along the line III—III of FIG. 2 but of slightly smaller scale.

The apparatus shown in FIGS. 1-3 of the drawing is intended for the external calibration or sizing of a longitudinally welded pipe 1 and hence for imparting the desired external diameter thereto.

The pipe 1 is displaceable in the direction of arrow 2 by a drive mechanism not shown and rides upon rollers 21, 22, 29. The rollers 21 and 22 are mounted upon a support rail 20 which is connected by a pair of links 23, only one of which has been shown, to respective nuts by articulations 24. The nuts can be drawn toward one another by a threaded spindle 28 upon rotation thereof. The links 23 are, in addition, pivotally connected to links 25 which are hinged at 26 to supports 27 for the spindle 28. Thus, when the spindle 28 is rotated, the rail 20 is raised and lowered to adjust the rollers 21 and 22 to the particular diameter of the pipe 1 to be processed.

Similarly, a spindle 35 drives a pair of nuts, not shown, one of which is hinged at 32 to a link 31 connected to a rail 30 carrying the rollers 29 at the downstream side of the apparatus. A link 33 connected hingedly to the link 31 is also swingably mounted to the journal block 34 for the spindle 35.

Between the rails 20 and 30 there is disposed a calibrating tool which comprises a machine support or frame 13 within which the outer support ring 3 is integrated.

Referring to FIG. 2, it will be apparent that the support 13 is, in turn, annular and is provided along its periphery with eyes 40 which are traversed by drawbolts 43 secured by nuts 44 and 45. Between the eyes 40 and the eyes 41 on the external periphery of the ring 3, there are provided respective spacer sleeves 42.

The support ring 3 is provided with a wedge mechanism, generally represented at 4 and with a piston-and-cylinder arrangement generally represented at 5.

The wedge mechanism 4 displaces the calibrating tool segments 6. As can be seen from FIG. 3, the tool segments 6 are formed with arcuate internal surfaces 65 engageable with the outer surface of the pipe 1 to size and calibrate the latter.

The support ring 3 is, as has been described, integrated in the machine frame generally represented at 13.

As can be seen especially from FIGS. 2 and 3, the support ring 3 is formed as a cylinder for the piston-and-cylinder arrangement 5 previously mentioned. To this end, the cylinder 3 receives a tubular (annular) axially displaceable piston 7 which defines a pressurizable compartment 8 with the cylinder 3. A passage 50 serves to deliver the hydraulic pressure medium to the chamber 8.

On either side of the chamber 8, the cylinder 3 and the piston 7 are provided with cylinderical surfaces between which are disposed respective sealing rings 9 to seal the chamber 8 from the exterior. The sealing rings 9 may be flanked by rigid seal-supporting members in the form of bronze rings or the like.

The inner surface of the annular piston 7 is provided with inclined wedging faces 10 which bear upon intermediate wedging members 11 which have complementary faces engaging the faces 10. Inwardly along the intermediate elements 11, the tools 6, previously described, are provided.

The apparatus is so constructed as is especially shown in FIG. 2, that the pressure within the chamber 8 exerts inwardly directed radial forces which are balanced by the outward radial forces of reaction during the calibration processes. The inclination of the face 10 of each intermediate element 11 is such that these forces are approximately in balance so that there is no net radial force upon the annular piston 7 and diameter changer thereof is not to be feared.

While the piston 7 can be double acting, in the embodiment shown in FIG. 2, it is a simple single-acting piston. It serves, upon pressurization of the chamber 8, to advance the tools 6 inwardly against the pipe 1. The resetting of the annular piston 7 is effected by one or more cylinder arrangements 12 whose pistons pass through the machine frame 13 to bear upon the piston 7. The cylinders 12 are anchored at 14 against the machine frame.

As can be seen particularly from FIG. 3, the wedge faces 10 are carried by inwardly projecting ribs 60 which have dovetail cross sections and engage in dovetail grooves 61 of the intermediate elements 11. Similarly, the dovetail projections 63 engage in dovetail recesses 64 of the tools 6. The dovetail arrangement coupling each tool 6 to the piston 7 is represented generally at 15. A pair of continuously adjustable axial stops 51 and 52 are provided on the piston 7 to limit the displacement thereof relative to the cylinder 3 in either direction. The stops 51 and 52 may be nuts threaded onto the piston 7 directly or onto rings intervening between the piston and the nuts. These rings can be force-fitted onto the piston.

The apparatus shown in FIGS. 1-3 of the drawing operates in the manner described in the aforementioned patent to calibrate pipe 1 except that the tools 6 are displaced by pressurizing the chamber 8 and thereby axially displacing the piston 7.

Figure 4:
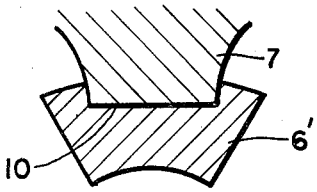
FIG. 4 is a detail view corresponding to the section of FIG. 3 but illustrating another embodiment of the invention.

FIG. 4 shows that the tool can be integrated with the intermediate element so that only the tool 6′ is formed between the piston 7 and the workpiece. In this case the tool 6′ is provided with a dovetail engaging the piston 7 directly and has the wedging surface complementary to the face 10 previously described.

The support 13 is provided with a plurality of inwardly extending slotted lugs 71 in which pins 70 connected to the intermediate elements 11 are radially guided.

I claim:

1. An apparatus for the external calibration of tubular workpieces, comprising:

a support;

an outer ring mounted on said support and traversed by said workpiece;

an annular piston member received in said ring and defining an annular pressurizable chamber therewith whereby said ring forms an annular cylinder for said piston member, said piston member being axially displaceable upon pressurization of said chamber, said piston member being formed along its interior with a plurality of wedging faces inclined to the axis of said workpiece, said piston member, said chamber, said cylinder, and said ring being coaxial; and a plurality of angularly spaced members including tool segments disposed inwardly of said piston member and biased inwardly against said workpiece by engagement of said wedging faces with complementary wedging surfaces upon axial displacement of said piston member, said piston member and each of said angularly spaced members being interconnected by complementary dovetail formations coupling said segments to said piston member, each of said angularly spaced members including a respective intermediate element between each of said segments and said piston member, said intermediate elements being formed with a respective said surface complementary to and slidably engaging a respective wedging face of said piston member, one such dovetail formation connecting each of said elements with said piston member and being provided with said wedging surface and face.

2. The apparatus defined in claim 1 wherein another such dovetail formation couples each of said segments to the respective intermediate element.

3. The apparatus defined in claim 1, further comprising stroke-limiting abutments for restricting the axial displacement of said piston member.

4. The apparatus defined in claim 3 wherein said abutments are continuously adjustable relative to said piston member.

5. The apparatus defined in claim 1 wherein said piston member is double acting upon pressurization of said cylinder and said cylinder is pressurizable to displace said piston member in one direction to urge said segments toward said workpiece and in the opposite direction to retract said segments.

6. The apparatus defined in claim 1, further comprising at least one restoring-cylinder arrangement on said support acting upon said piston member to displace the same in a direction opposite the displacement of said piston member upon pressurization of said chamber.

7. An apparatus for the external calibration of tubular workpieces, comprising:

a support;

an outer ring mounted on said support and traversed by said workpiece;

an annular piston member received in said ring and defining an annular pressurizable chamber therewith whereby said ring forms an annular cylinder for said piston member, said piston member being axially displaceable upon pressurization of said chamber, said piston member being formed along its interior with a plurality of wedging faces inclined to the axis of said workpiece, said piston member, said chamber, said cylinder, and said ring being coaxial; and a plurality of angularly spaced members including tool segments disposed inwardly of said piston member and biased inwardly against said workpiece by engagement of said wedging faces with complementary wedging surfaces upon axial displacement of said piston member, said piston member and each of said angularly spaced members being interconnected by complementary dovetail formations coupling said segments to said piston member, said support being annular and being provided on its periphery with a plurality of eyes, said ring being provided on its periphery with a corresponding number of eyes, said apparatus further comprising respective tiebars interconnecting the opposite eyes of said ring and said support, respective spacer sleeves between said opposite eyes, said chamber being disposed radially outwardly of said wedging faces, and respective annular seals disposed between juxtaposed cylindrical surfaces of said ring and said piston member on opposite axial sides of said chamber, respective intermediate elements being interposed between each of said wedging faces and a respective segment, said intermediate elements being formed with wedging faces inclined to the wedging surfaces of said piston member, said piston member and each of said intermediate elements having complementary dovetail formations connecting each of said elements to said piston member, each of said elements and the respective segment having complementary dovetail formations interconnecting same.

* * * * *